US008096029B2

(12) United States Patent
Lanz et al.

(10) Patent No.: US 8,096,029 B2
(45) Date of Patent: Jan. 17, 2012

(54) DEVICE FOR MAINTAINING THE CRIMPING OF TEXTILE FIBERS OR FILAMENTS DURING SUBSEQUENT SETTING

(75) Inventors: Gunther Lanz, Guebwiller (FR); Jean-Louis Schuller, Mulhouse (FR); Didier Thibault, Bru (FR); Philippe Massotte, Gueberschwihr (FR); Pierre Henry, Rixheim (FR)

(73) Assignee: Cogia, Mulhouse (FR)

( * ) Notice: Subject to any disclaimer, the term of this patent is extended or adjusted under 35 U.S.C. 154(b) by 465 days.

(21) Appl. No.: 12/290,381

(22) Filed: Oct. 30, 2008

(65) Prior Publication Data

US 2009/0106958 A1 Apr. 30, 2009

Related U.S. Application Data

(60) Provisional application No. 61/007,029, filed on Dec. 10, 2007.

(30) Foreign Application Priority Data

Oct. 30, 2007 (FR) ..... 07 58688

(51) Int. Cl.
*D02G 1/00* (2006.01)

(52) U.S. Cl. ..... 28/266; 28/221

(58) Field of Classification Search ..... 28/247, 28/248, 250, 263, 262, 266, 258, 221, 257, 28/256; 264/282, 168; 68/5 C, 5 D
See application file for complete search history.

(56) References Cited

U.S. PATENT DOCUMENTS

| | | | | | |
|---|---|---|---|---|---|
| 3,044,145 | A * | 7/1962 | Tager et al. | ..... | 28/266 |
| 3,065,519 | A * | 11/1962 | Starkie | ..... | 28/262 |
| 3,160,923 | A * | 12/1964 | Rainard et al. | ..... | 28/266 |
| 3,354,511 | A | 11/1967 | Ross | | |
| 3,406,436 | A * | 10/1968 | Clarke, Jr. | ..... | 28/250 |
| 3,679,533 | A * | 7/1972 | Fukuda et al. | ..... | 428/95 |
| 3,786,538 | A * | 1/1974 | Hutchinson et al. | ..... | 28/267 |
| 3,798,718 | A * | 3/1974 | Trifunovic | ..... | 28/262 |
| 4,161,054 | A * | 7/1979 | Serracant Clermont | ..... | 26/21 |
| 4,571,765 | A | 2/1986 | Okada et al. | | |
| 5,210,916 | A * | 5/1993 | Enderlin | ..... | 28/278 |
| 6,351,877 | B1 * | 3/2002 | Harris et al. | ..... | 28/263 |
| 6,385,827 | B1 * | 5/2002 | Stewart et al. | ..... | 28/263 |

* cited by examiner

*Primary Examiner* — Amy Vanatta
(74) *Attorney, Agent, or Firm* — The Watson I.P. Group, PLC; Jovan N. Jovanovic; Vladan M. Vasiljevic

(57) ABSTRACT

A device for maintaining the crimping of textile fibers or filaments during subsequent setting treatment, located in a line for treating filaments by crimping and setting having a crimping machine (1), whereby this device is connected to the outlet of the crimping machine (1) and consists of two perforated conveyor belts (2), between which is fed the plug of textile fibers or filaments (3) coming from the crimping machine (1) and which pass through a setting oven or other setting machine to arrive at a filament uptake area. The device is provided with a member (6) for maintaining the continuity of the pressure on the plug of textile fibers or filaments (3) at the outlet of the crimping machine (1) and during the entire setting operation, whereby this member cooperates with the perforated conveyor belts (2).

18 Claims, 5 Drawing Sheets

DEVICE FOR MAINTAINING THE CRIMPING OF TEXTILE FIBERS OR FILAMENTS DURING SUBSEQUENT SETTING

CROSS-REFERENCE TO RELATED APPLICATION

This application claims priority from French Application No. 0758688 filed Oct. 30, 2007 having the same title as the instant application (in French). This application also claims priority from U.S. Provisional Patent Application Ser. No. 61/007,029 filed Dec. 10, 2007 having the same title as the instant application. Both applications are incorporated herein by reference in their entireties.

BACKGROUND OF THE DISCLOSURE

1. Field of the Disclosure

The present invention concerns the field of the textile industry, in particular the treatment of filaments and more specifically texturing by crimping, and its object is a device for maintaining the crimping of textile fibers or filaments during subsequent setting treatment.

2. Background Art

Crimping textile fibers by means of a crimping machine has long been known, and consists in crimping the textile fibers or filaments by means of a crimping machine and depositing the filaments or fibers in the form of a continuous plug of loops on a conveyor belt. Then the plug obtained is subjected to a setting operation, during which the crimping is made permanent for the purpose of subsequent processing of the filament or fibers.

A great majority of treated filaments or fibers thus retain the entire deformation acquired in the crimping machine.

But some filaments and fibers have a residual stiffness that has the effect of causing partial un-crimping of the loops obtained at the outlet of the crimping machine and during their transport to the downstream setting machine, as well as during their treatment in this machine.

To solve this problem, FR-A-1 192 453 and FR-A-2 681 342 proposed devices acting as an extension of a crimping machine and making it possible to maintain the crimping, either by forced guidance of the plug of textile fibers or filaments into a heat-setting oven or other setting device, between conveyor belts tending to squeeze the plug during its transport into the oven or other device (FR-A-1 192 453), or by forced accompaniment of the sequence of crimps forming the plug in order to prevent these crimps from losing some of the acquired deformation by stretching out during their treatment run in the oven or other setting device (FR-A-2 681 342).

In the first case, the plugs are compressed between two perforated conveyor belts passing through the oven or other setting device, so that they cannot undergo any vertical deformation by swelling.

In the second case, the crimps are forced along by means of clamps roughly maintaining their spacing and their shape during the passage through the oven or setting device.

No known device, however, makes it possible to avoid lateral deformation of the crimps between the means of transport and/or accompaniment, so that their elongation is still possible despite everything and the qualities required for subsequent processing are no longer guaranteed.

This is especially the case in the presence of filaments or fibers that are resistant to permanent deformation and thus have a tendency to lose the deformation acquired in the crimping machine as they enter and pass through a setting oven or else another setting device.

Also known from U.S. Pat. No. 4,571,765 is a device not using a conveyor belt to move the textile material to be crimped. But such a process limits the length of the treatment oven because of the friction of the textile material to be treated against the lateral and upper walls of the treatment channel. The result is the possibility of formation of a jam of the material in the treatment channel once the friction becomes too significant, especially as the material to be treated is pressed against all the walls. In addition, the friction can also cause a change in the shape of the expected crimps and increase the risk of snags in the treatment channel.

Moreover, U.S. Pat. No. 3,354,511 describes the treatment of natural fibers that have very little shortening due to the temperature of the treatment fluid. In this document, there is no possibility of height and width adjustment with the synchronized drive belts that would make it possible to maintain a constant compression without friction against the walls.

SUMMARY OF THE INVENTION

The goal of the present invention is to solve these problems by proposing a device for maintaining the crimping of textile fibers or filaments during subsequent setting treatment, making it possible to totally guarantee the maintenance of the initial deformation of the textile fibers or filaments.

According to the invention, this device, which consists of two perforated conveyor belts, between which is fed the plug of textile fibers or filaments coming from the crimping machine and which pass through a setting oven or other setting machine to arrive at a filament uptake area, is characterized by the fact that it is provided with a means for maintaining the continuity of the pressure on the plug of textile fibers or filaments at the outlet of the crimping machine and during the entire setting operation, whereby this means cooperates with the perforated conveyor belts.

BRIEF DESCRIPTION OF THE DRAWINGS

The invention will be better understood thanks to the description that follows, which refers to preferred embodiments given as non-limiting examples and explained with reference to the attached schematic drawings, in which.

DETAILED DESCRIPTION OF THE DRAWINGS

Figure 1:
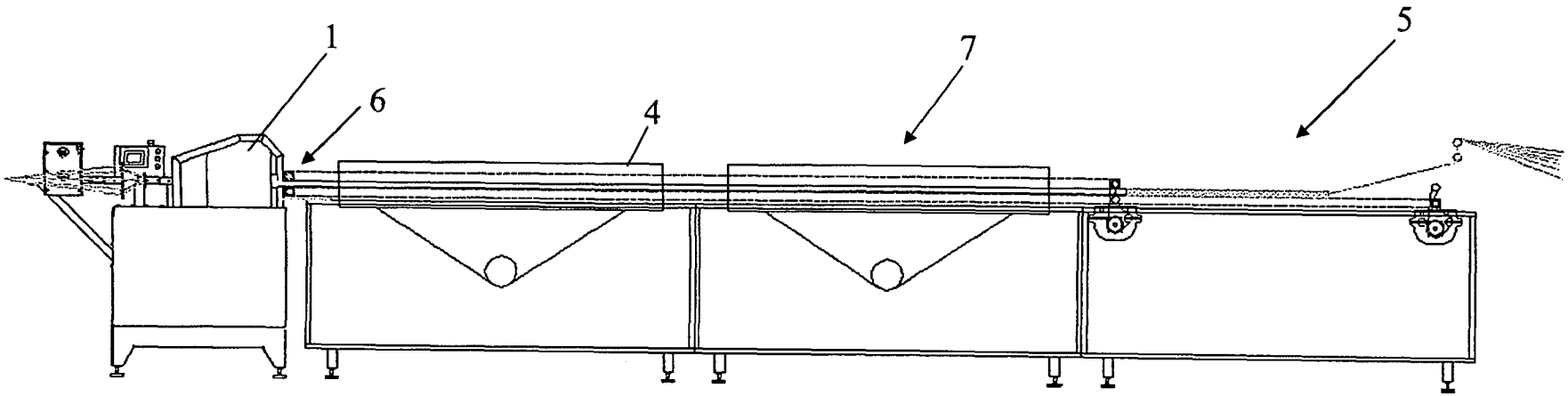
FIG. 1 is a side elevation of a line for filament treatment by crimping and setting using the device according to the invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

FIG. 1 of the attached drawings schematically shows a line for treating filaments by crimping and setting having a crimping machine 1 whose outlet is connected to a device for maintaining the crimping of textile fibers or filaments during subsequent setting treatment, which consists of two perforated conveyor belts, between which is fed the plug of textile fibers or filaments 3 coming from the crimping machine 1 and which pass through a setting oven 4 or other setting machine to arrive at a filament uptake area 5.

According to the invention and as shown more specifically by FIGS. 2 and 3 and 7 to 9, the device for maintaining the crimping of textile fibers or filaments during subsequent setting treatment is provided with a means 6 for maintaining the continuity of the pressure on the plug of textile fibers or filaments 3 at the outlet of the crimping machine 1 and during the entire setting operation, whereby this means cooperates with the perforated conveyor belts 2.

Figure 2:
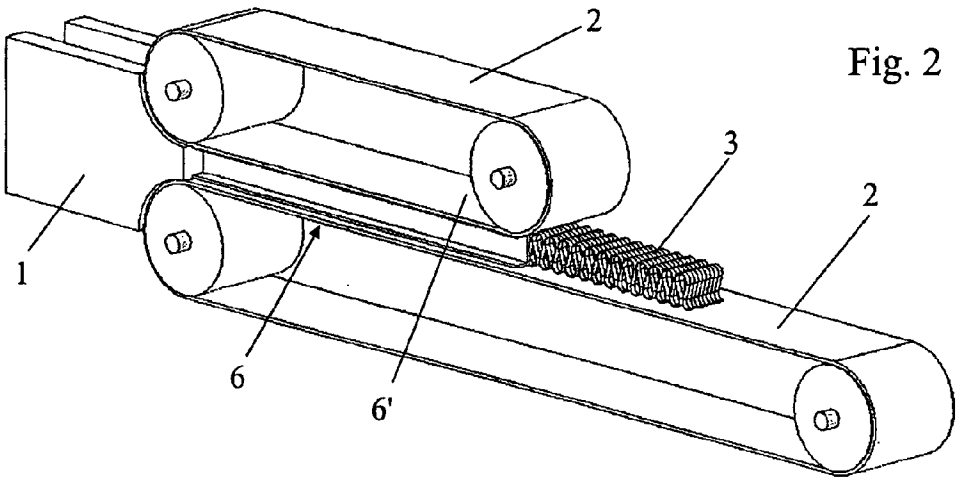
FIG. 2 is a partial perspective view on a larger scale, showing a first embodiment of the device according to the invention.
Figure 3:
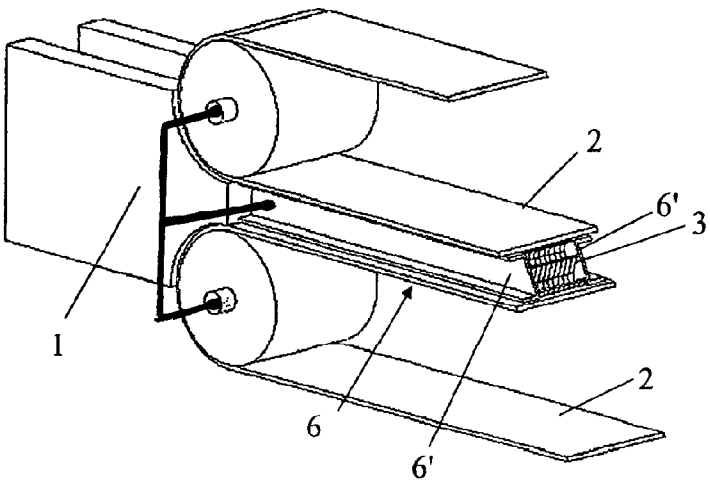
FIG. 3 is a perspective and cross-sectional view of the device of FIG. 2.

According to a first embodiment of the invention shown in FIGS. 2 and 3 of the attached drawings, the means 6 for maintaining the continuity of the pressure on the plug of textile fibers or filaments 3 at the outlet of the crimping machine 1 and during the entire setting operation is in the form of a pair of rails 6' located between the perforated conveyor belts 2, on either side of the plug of textile fibers or filaments 3. These rails 6' extend from the outlet of the crimping machine 1 over the entire length of the passage through the setting oven 4 or other setting machine. These rails 6' can be attached to the support frame of the perforated conveyor belts 2 by means of supports that are part of this latter. These supports are not shown in detail in the attached drawings, but their design is a type completely accessible to the expert in the field and does not require an additional description.

According to one characteristic of the invention, the rails 6' can be adjusted in terms of their position between the conveyor belts 2 so as to be closer together and/or farther apart, by their adjustable mounting on the supports that are part of the support frame of the perforated conveyor belts 2. Such an adjustable mounting can be accomplished by the use of pneumatic jacks controlled from a control console or by a programmable robot or by means of mechanical control devices of the type with threaded pins and nuts. Thus it is possible to vary the width of the plug of textile fibers or filaments over the entire length of its movement between the conveyor belts 2 and to compensate for the reduction in pressure on the fibrous wad constituting the plug between the conveyor belts 2 during its run through the setting oven 4 or other setting machines.

Such compensation may prove necessary in the case of thermal treatment with the effect of causing shrinkage of the fibers or filaments. In fact, a lack of compensation would reduce the pressure on the plug and thus allow undesired deformation of the crimps forming this plug.

Figure 4:
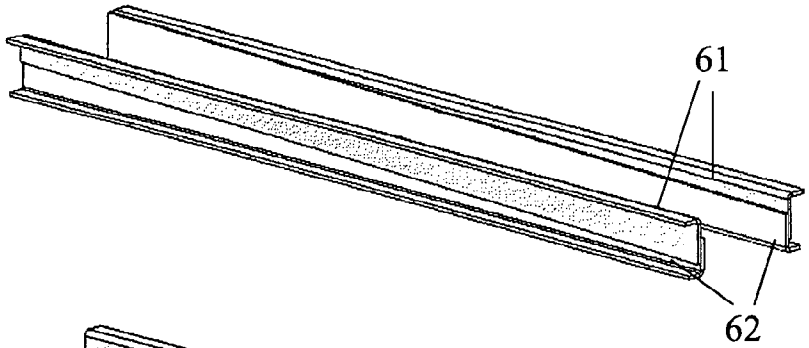
FIGS. 4 to 6 are perspective views showing a second embodiment of the device according to FIGS. 2 and 3 in three different working positions.
Figure 5:
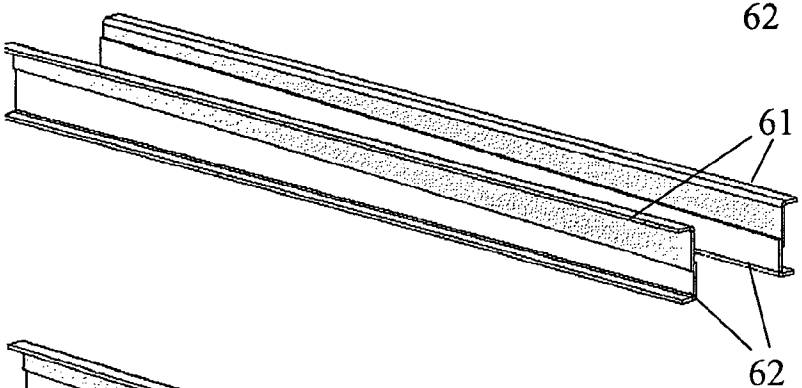
Figure 6:
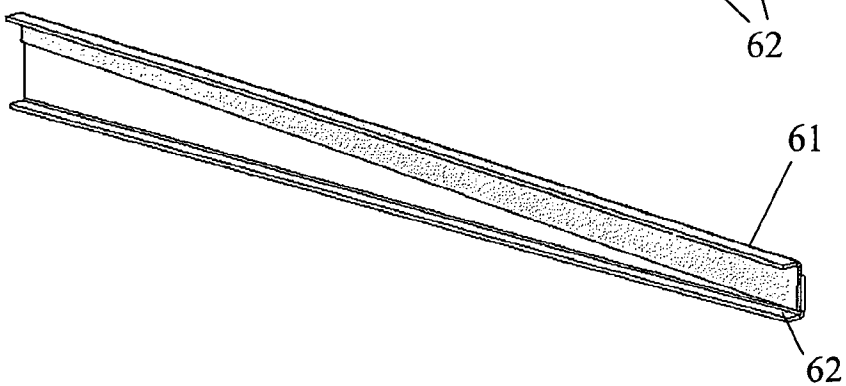

FIGS. 4 to 6 of the attached drawings show a second embodiment of the invention in which the means 6 for maintaining the continuity of the pressure on the plug of textile fibers or filaments 3 at the outlet of the crimping machine 1 and during the entire setting operation is in the form of two pairs of guillotine-like rails 61, 62 located between the perforated conveyor belts 2, on either side of the plug of textile fibers or filaments 3, whereby at least one of the conveyor belts 2 can move in a vertical plane relative to the other.

According to one characteristic of the invention, one pair of these rails 61 is connected to the support frame of the upper perforated conveyor belt 2 and the other pair of rails 62 is connected to the support frame of the lower perforated conveyor belt 2.

Preferably, the pairs of rails 61 and 62 have the same shape and each have a horizontal flange of constant width for support on the corresponding perforated conveyor belt 2 and a vertical flange with a height that varies linearly from one end to the other, whereby these rails 61 and 62 are located opposite each other on either side of the plug of textile fibers or filaments 3 and are guided with friction of their adjacent vertical flanges (FIGS. 4 to 6) by means of supports (not shown) provided on the corresponding frames of the perforated conveyor belts 2.

The upper perforated conveyor belt 2 is advantageously mounted so as to move on its support frame in a vertical plane relative to the lower conveyor belt 2, and this ability to move is conferred by providing connecting jacks acting on the ends of the conveyor belt 2, between the support frame and the conveyor belt 2. Thus it is possible to vary the gap between the two conveyor belts 2 so that it is either the same over their entire length or changes linearly from a maximum corresponding to the outlet of the crimping machine 1 to a minimum corresponding to the outlet of the oven 4 or other setting machine, whereby the upper pair of rails 61 follows the movement of the upper conveyor belt 2 and in any case ensures the continuity of the lateral maintenance of the plug of textile fibers or filaments 3.

FIGS. 4 to 6 of the attached drawings respectively show a position of minimum vertical extension of the rails 61, 62 corresponding to a maximum pressure over the entire length of the plug of textile fibers or filaments 3, a maximum extension of the rails 61, 62 corresponding to a minimum and constant pressure on the plug of textile fibers or filaments 3, and a position of progressive reduction of the height of the plug of textile fibers or filaments 3. According to another characteristic of the invention, the pairs of rails 61, 62 can be mounted on the support frames of the perforated conveyor belts 2 so as to move transversely with respect to the longitudinal axis of these perforated conveyor belts 2. In such a case, it is sufficient to make each set of rails 61-62 of the two pairs of rails 61, 62 on each side move back and forth together, whereby one of the rails 61 or 62 is provided with a means for transverse movement in the form of jacks acting preferentially at its ends and these jacks are furthermore connected to the support frame of the rails 61 or the rails 62.

Thus it is possible to vary the width of the plug of textile fibers or filaments 3 at the same time as the thickness of this plug by acting on it in both directions, that is, bringing together the perforated conveyor belts 2 on the one hand and the pairs of rails 61, 62 on the other.

Figure 7:
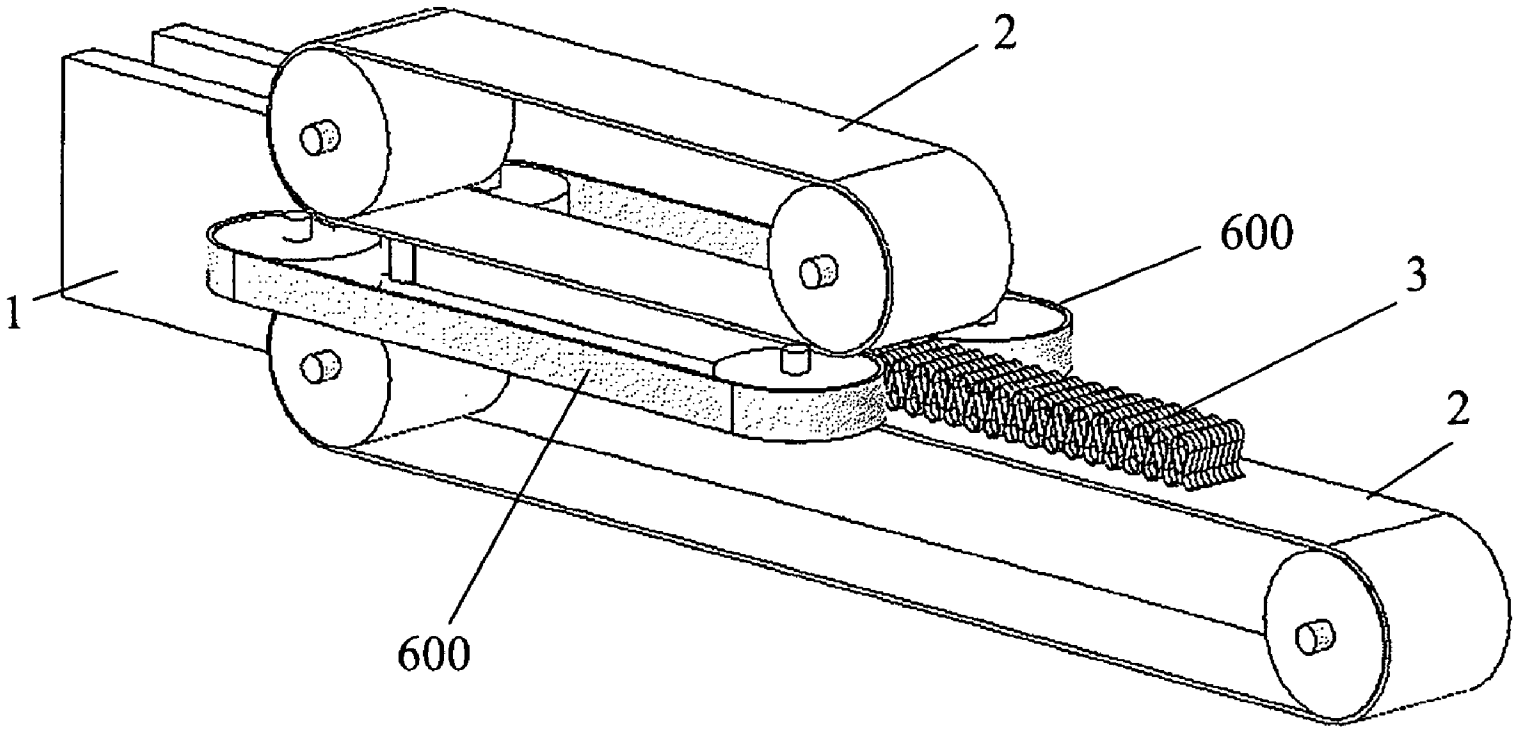
FIG. 7 is a view analogous to FIG. 2 of a third embodiment of the invention.
Figure 8:
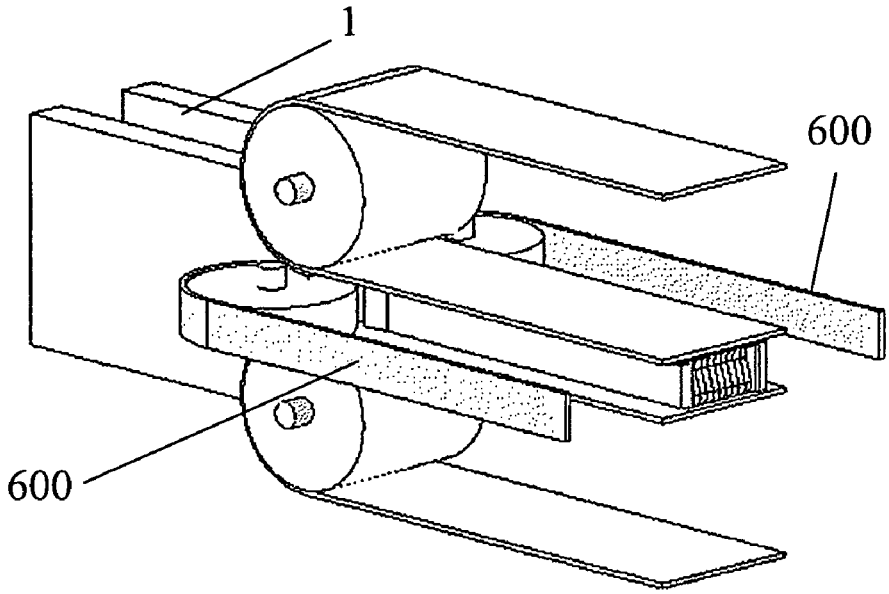
FIG. 8 is a view analogous to FIG. 3 of the embodiment according to FIG. 7.
Figure 9:
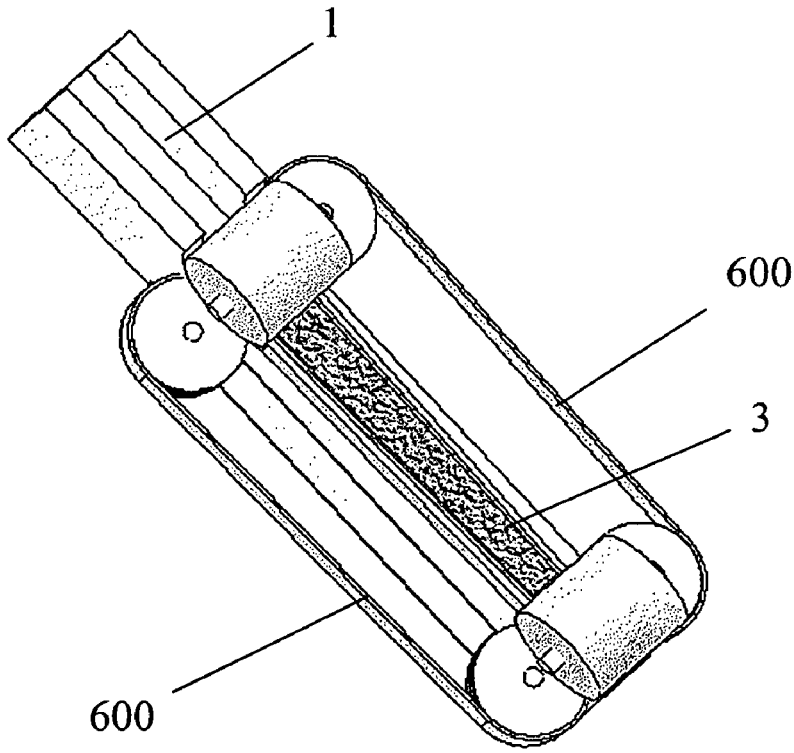
FIG. 9 is a smaller-scale view showing the device according to FIGS. 7 and 8 in a position of compensation for the shortening of the plug or the mass of textile fibers or filaments.

FIGS. 7 to 9 of the attached drawings show a third embodiment of the invention, in which the means 6 for maintaining the continuity of the pressure on the plug of textile fibers or filaments 3 at the outlet of the crimping machine 1 and during the entire setting operation is in the form of a pair of lateral continuous driving devices 600 extending along either side of the plug of textile fibers or filaments 3, between the perforated conveyor belts 2. These lateral continuous driving devices 600 are in the form of smooth belts with notches or teeth.

Moreover, these lateral continuous driving devices 600 may also be mounted so as to move between the perforated conveyor belts 2 by mounting the bearings of their return pulley on means of movement with mechanical, hydraulic, or pneumatic jacks.

Like the design described with respect to FIGS. 2 and 3, this type of mounting makes it possible to vary the width of the plug of textile fibers or filaments 3 and thus compensate for variations in pressure that might occur during setting.

According to another characteristic of the invention, the drive speed of the perforated conveyor belts 2 can be adjusted as a function of the rate of production of the plug of textile fibers or filaments 3 from the crimping machine 1 by means of an automatic device (not shown) taking into account the pressure exerted on the plug in the setting oven 4 or other setting machine. Thus continuous adjustment of the plug of textile fibers or filaments 3 is achieved, guaranteeing a uniform product at the outlet of the setting oven 4 or other setting machine.

The control of the movement of the rails 6', 61, 62 or the lateral continuous driving devices 600, in the sense of control of the pressure exerted on the plug of textile fibers or filaments 3, can also be managed by means of an automatic device taking into account various parameters that can be measured or evaluated during the run of the plug of textile fibers or filaments 3.

According to another characteristic of the invention and as shown in FIG. 1 of the attached drawings, at the outlet of the setting oven 4 or other setting machine the device may pass through a cooling zone 7 before arriving at the filament uptake area 5. In such a cooling zone, the plug of textile fibers or filaments 3 is subjected to a circulation or air or another cold or refrigerated gas, which causes additional or accentuated setting of the deformation conferred upon the textile fibers or filaments.

Thanks to the invention, it is possible to carry out the setting of textile fibers or filaments that completely retain their shape for the duration without risk of deterioration, so that the crimped filament obtained at the outlet of a crimping line equipped with the device according to the invention is completely uniform.

Of course the invention is not limited to the embodiments described and shown in the attached drawings. Modifications are still possible, in particular from the standpoint of the nature of the various elements or by substitution of equivalent techniques, without leaving the scope of protection of the invention.

What is claimed is:

1. Device for maintaining the crimping of textile fibers or filaments during subsequent setting treatment, located in a line for treating filaments by crimping and setting having a crimping machine (1), whereby this device is connected to an outlet of a crimping machine (1) and comprises two perforated conveyor belts (2), between which is fed the plug of textile fibers or filaments (3) coming from the crimping machine (1) and which pass through a setting oven (4) or other setting machine to arrive at a filament uptake area (5), characterized by the fact that the device is provided with a means (6) for maintaining the continuity of pressure on the plug of textile fibers or filaments (3) at the outlet of the crimping machine (1) and during the entire setting operation, whereby this means cooperates with the perforated conveyor belts (2).

2. Device according to claim 1, characterized by the fact that the means (6) for maintaining the continuity of the pressure on the plug of textile fibers or filaments (3) at the outlet of the crimping machine (1) and during the entire setting operation is in the form of a pair of rails (6') located between the perforated conveyor belts (2), on either side of the plug of textile fibers or filaments (3).

3. Device according to claim 2, characterized by the fact that the rails (6') extend from the outlet of the crimping machine (1) over the entire length of the passage through the setting oven (4) or other setting machine.

4. Device according to claim 2, characterized by the fact that the rails (6') are attached to a support frame of the perforated conveyor belts (2) by means of supports that are part of the support frame.

5. Device according to claim 2, characterized by the fact that the rails (6') are adjusted in terms of position between the conveyor belts (2) so as to come closer together and/or farther apart, by their adjustable mounting on supports that are part of a support frame of the perforated conveyor belts (2).

6. Device according to claim 5, characterized by the fact that the adjustable mounting of the rails (6') is accomplished using pneumatic jacks controlled from a control console or by a programmable robot or by means of mechanical control devices of the type with threaded pins and nuts.

7. Device according to claim 1, characterized by the fact that the means (6) for maintaining the continuity of the pressure on the plug of textile fibers or filaments (3) at the outlet of the crimping machine (1) and during the entire setting operation is in the form of two pairs of guillotine-like rails (61, 62) located between the perforated conveyor belts (2), on either side of the plug of textile fibers or filaments (3), whereby at least one of the conveyor belts (2) can move in a vertical plane relative to the other.

8. Device according to claim 7, characterized by the fact that one pair of rails (61) is connected to the support frame of the upper perforated conveyor belt (2) and the other pair of rails (62) is connected to the support frame of the lower perforated conveyor belt (2).

9. Device according to claim 7, characterized by the fact that the pairs of rails (61 and 62) have identical shapes and each have a horizontal flange of constant width for support on the corresponding perforated conveyor belt (2) and a vertical flange with a height that varies linearly from one end to the other, whereby these rails (61 and 62) are located opposite each other on either side of the plug of textile fibers or filaments (3) and are guided with friction of their adjacent vertical flanges by means of supports provided on the corresponding frames of the perforated conveyor belts (2).

10. Device according to claim 1, characterized by the fact that upper perforated conveyor belt (2) is mounted so as to move on its support frame in a vertical plane relative to the lower conveyor belt (2), whereby this ability to move is conferred by providing connecting jacks acting on the ends of the conveyor belt (2), between the support frame and the conveyor belt (2).

11. Device according to claim 7, characterized by the fact that the pairs of rails (61, 62) are mounted on support frames of the perforated conveyor belts (2) so as to move transversely with respect to the longitudinal axis of these perforated conveyor belts (2).

12. Device according to claim 11, characterized by the fact that each set of rails (61-62) of the two pairs of rails (61, 62) on each side moves back and forth together, whereby one of the rails (61 or 62) is provided with a means for transverse movement in the form of jacks acting preferentially at its ends and these jacks are furthermore connected to the support frame of the rails.

13. Device according to claim 1, characterized by the fact that the means (6) for maintaining the continuity of the pressure on the plug of textile fibers or filaments (3) at the outlet of the crimping machine (1) and during the entire setting operation is in the form of a pair of lateral continuous driving devices (600) extending along either side of the plug of textile fibers or filaments (3), between the perforated conveyor belts (2).

14. Device according to claim 13, characterized by the fact that the lateral continuous driving devices (600) are in the form of smooth belts with notches or teeth.

15. Device according to claim 13, characterized by the fact that the lateral continuous driving devices (600) are mounted so as to move between the perforated conveyor belts (2) by mounting the bearings of their return pulley on means of movement with mechanical, hydraulic, or pneumatic jacks.

16. Device according to claim 1, characterized by the fact that a drive speed of the perforated conveyor belts (2) is adjustable as a function of the rate of production of the plug of textile fibers or filaments (3) from the crimping machine (1) by means of an automatic device taking into account the pressure exerted on the plug in the setting oven (4) or other setting machine.

17. Device according to claim 2, characterized by the fact that control of a movement of the rails (6', 61, 62) or a lateral continuous driving device (600), in the sense of control of the pressure exerted on the plug of textile fibers or filaments (3), is managed by means of an automatic device taking into account different parameters that can be measured or evaluated during the run of the plug of textile fibers or filaments (3).

18. Device according to claim 1, characterized by the fact that at the outlet of the setting oven (4) or other setting machine, the perforated conveyor belts pass through a cooling zone (7) before arriving at the filament uptake area (5).

* * * * *